US006616487B1

(12) United States Patent
Lai

(10) Patent No.: US 6,616,487 B1
(45) Date of Patent: Sep. 9, 2003

(54) PLUG CONNECTOR HAVING RETENTION STRUCTURE

(75) Inventor: Chin-Te Lai, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/393,595

(22) Filed: Mar. 20, 2003

(30) Foreign Application Priority Data

Dec. 25, 2002 (TW) ..... 91137234 A

(51) Int. Cl.[7] ..... H01R 24/04
(52) U.S. Cl. ..... 439/668; 439/606; 439/669
(58) Field of Search ..... 439/668, 669, 439/606, 675

(56) References Cited

U.S. PATENT DOCUMENTS 4,704,091 A * 11/1987 Owens et al. ..... 439/606
5,595,497 A * 1/1997 Wood ..... 439/606
6,394,852 B1 * 5/2002 Huang ..... 439/669
6,439,933 B1 * 8/2002 Moji ..... 439/669
6,461,198 B1 10/2002 Chao
6,461,199 B1 * 10/2002 Koga et al. ..... 439/668

FOREIGN PATENT DOCUMENTS

TW 406884 9/2000

* cited by examiner

*Primary Examiner*—Tho D. Ta
(74) *Attorney, Agent, or Firm*—Wei Te Chung

(57) ABSTRACT

A plug connector (1) includes a housing (4), an audio plug (2) retained to the housing and a number of terminals (6) received in the housing. The housing has a base (41). A spacer (44) extends rearwardly from a rear face (411) of the base and having a projection (443). The audio plug includes a first and a second contacts (22, 23) insulated by an insulator (25) and each having a contact portion (220, 230), an extension portion (221, 231) extending from the contact portion and a rear portion (222, 232) extending from the extension portion. A part of the rear portion of the first contact is exposed on one side of the insulator and a part of the rear portion of the second contact is exposed on another side opposite to the first side.

3 Claims, 5 Drawing Sheets

PLUG CONNECTOR HAVING RETENTION STRUCTURE

BACKGROUND OF THE INVENTION

1. Field of the Invention

The present invention is related to a plug connector, and more particularly to a plug connector transmitting audio signals.

2. Description of Related Art

Plug and jack type connectors are well known for use in connecting audio equipments. The plugs and jacks only transmit audio signals in an earlier stage. Later on, a few individual contacts are provided on a plug connector to transmit other signals. U.S. Pat. No. 6,461,198 discloses in FIG. 2 thereof such a plug connector. In use, rear ends of contacts of the plug connector are connected to wires of a cable before a rear portion of the plug connector is molded in a plastic enclosure.

The plug connector of U.S. Pat. No. 6,461,198 has several disadvantages to overcome. First, the plug connector has no retention structure to engage with the plastic enclosure in a direction along which the plug connector mates with a complementary jack connector, so after several matings of the plug connector and the jack connector, the plug connector will easily disengage from the enclosure, thereby adversely affecting an electrical and mechanical connection between the contacts thereof and the wires of the cable. Second, rear ends of coaxially arranged contacts of the plug connector are axially sequentially exposed from an insulative housing to be soldered with the wires of the cable, so the axial length of the plug connector is relatively large.

Hence, it is requisite to provide an improved plug connector to overcome the disadvantages.

SUMMARY OF THE INVENTION

Accordingly, an object of the present invention is to provide a plug connector having a retention structure to engage with an enclosure thereof.

Another object of the present invention is to provide a plug connector having a reduced length.

In order to achieve the objects set forth, a plug connector in accordance with the present invention comprises an insulative housing, an audio plug retained the housing and a plurality of terminals received in the housing. The housing comprises an elongated base having a front face and a rear face opposite to the front face, a tongue extending forwardly from the front face of the base, a plurality of passageways defined on the tongue and extending rearwardly throughout the base, and a spacer extending rearwardly from the rear face of the base and having a projection for engaging with the plastic of an enclosure in which the plug connector is molded. The audio plug comprises at least a first and a second contacts insulated by an insulator and each comprising a contact portion, an extension portion extending from the contact portion, and a rear portion extending from the extension portion. A part of the rear portion of the first contact is exposed on one side of the insulator and a part of the rear portion of the second contact is exposed on another side opposite to the first side.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
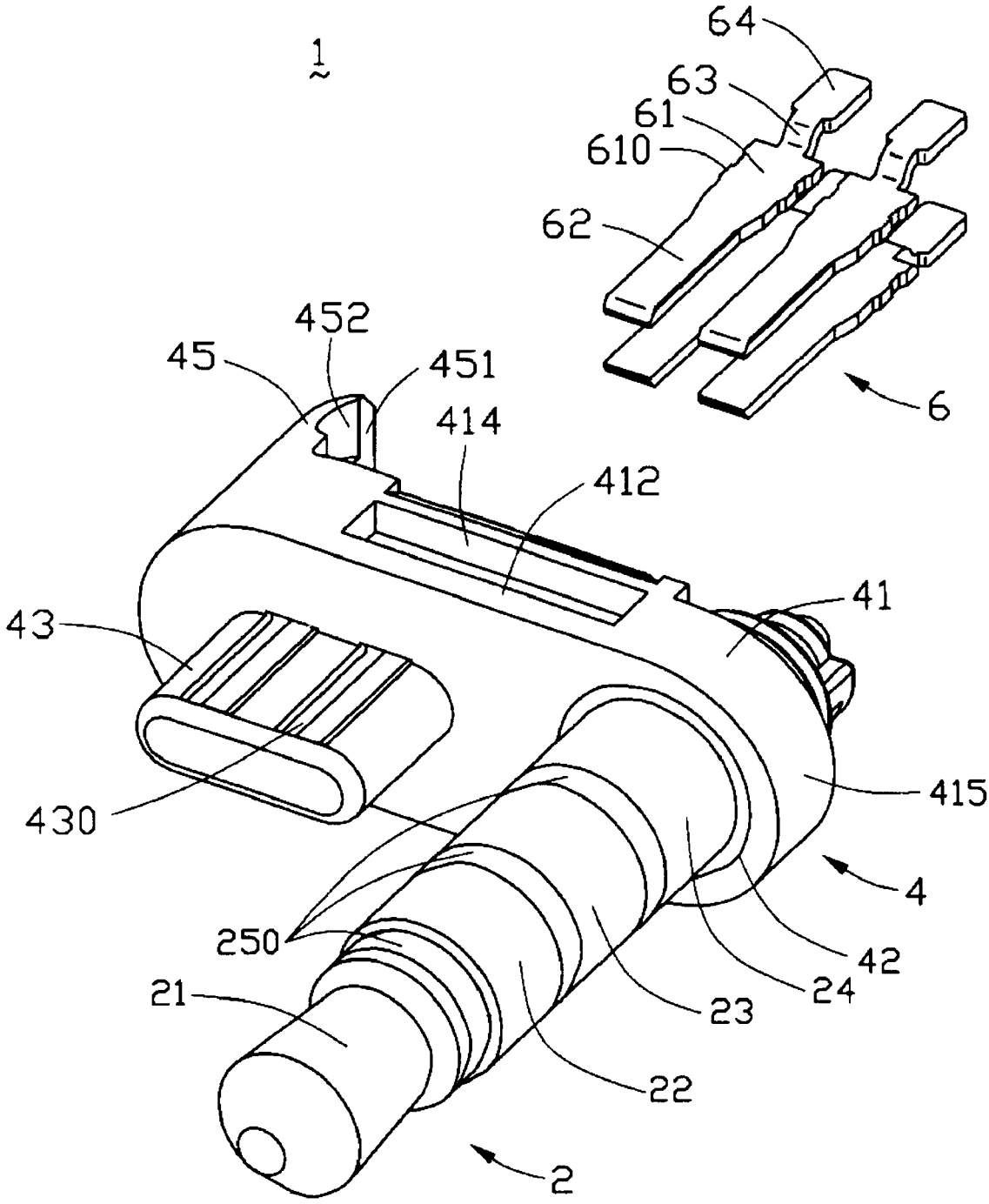
FIG. 1 is an exploded perspective view of a plug connector in accordance with the present invention.

Referring to FIG. 1, a plug connector 1 in accordance with the present invention comprises an audio plug 2, an insulative housing 4 and a plurality of terminals 6.

Figure 2:
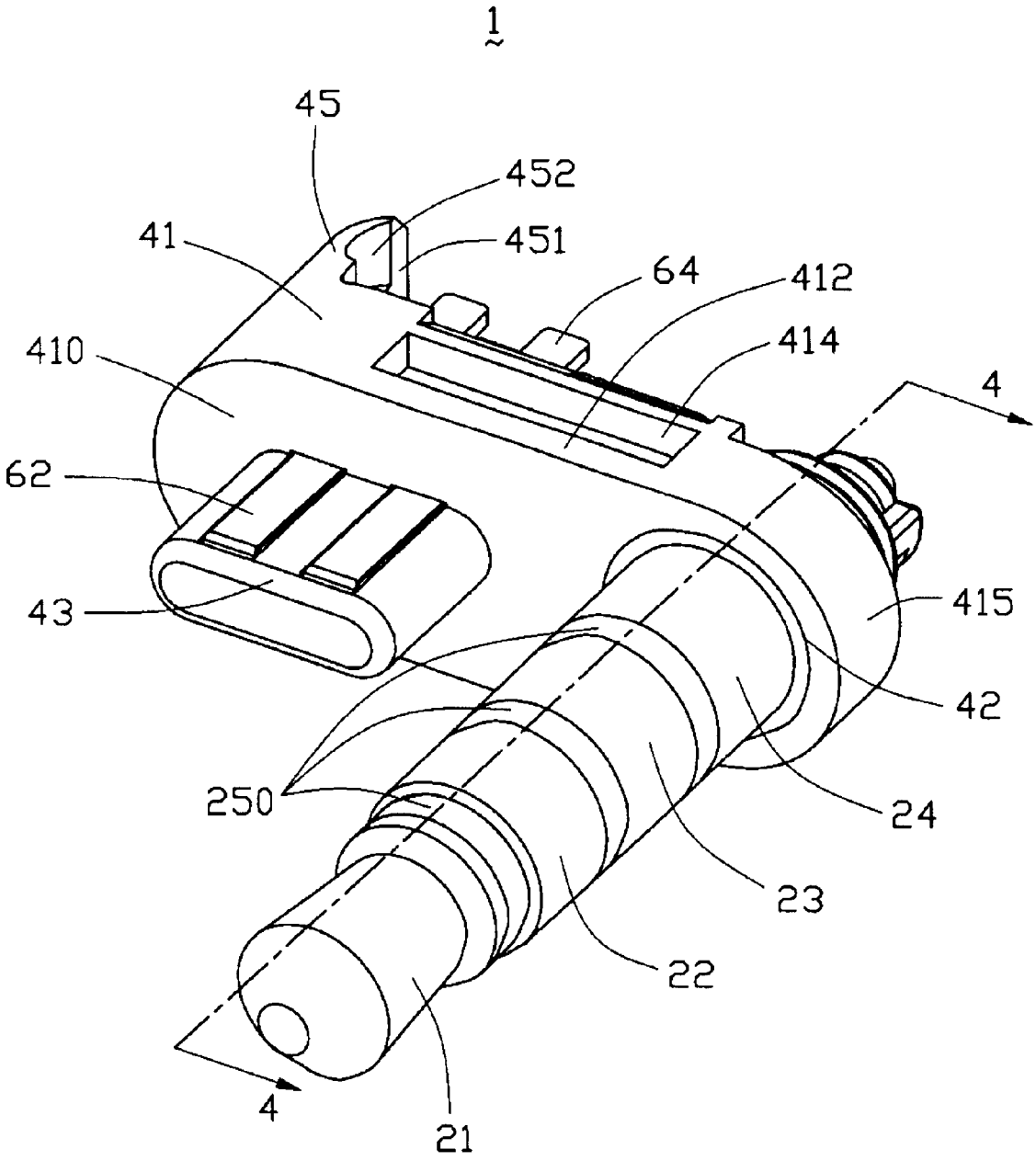
FIG. 2 is an assembled perspective view of the plug connector of FIG. 1.

Further referring to FIG. 2, the audio plug 2 comprises a first metallic contact 21, a second metallic contact 22, a third metallic contact 23, a fourth metallic contact 24, and an insulator 25 between the metallic contacts, i.e, the metallic contacts are insulated from each other by the insulator 25.

Figure 3:
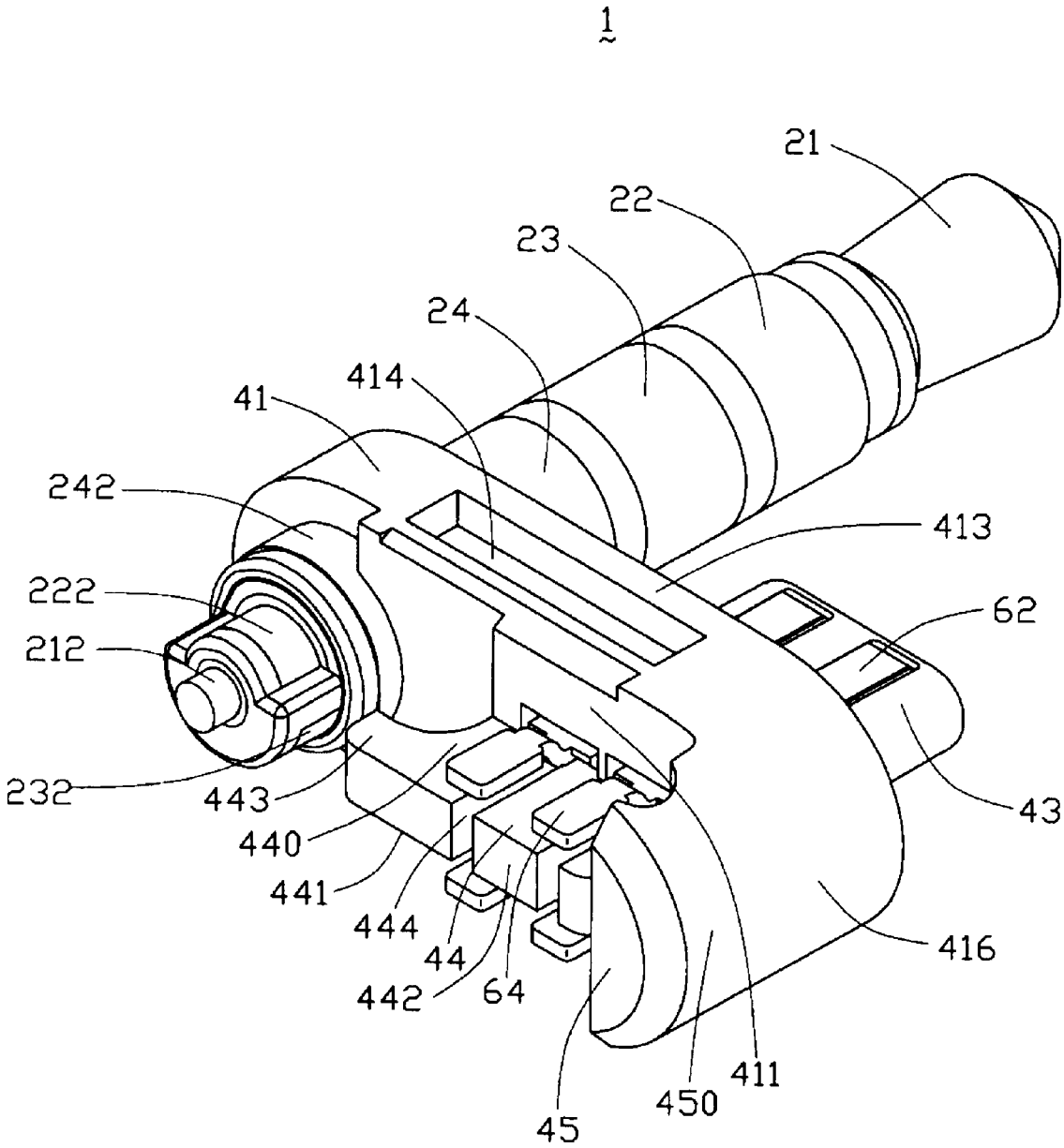
FIG. 3 is an assembled perspective view of the plug connector of FIG. 1 from a different aspect.
Figure 4:
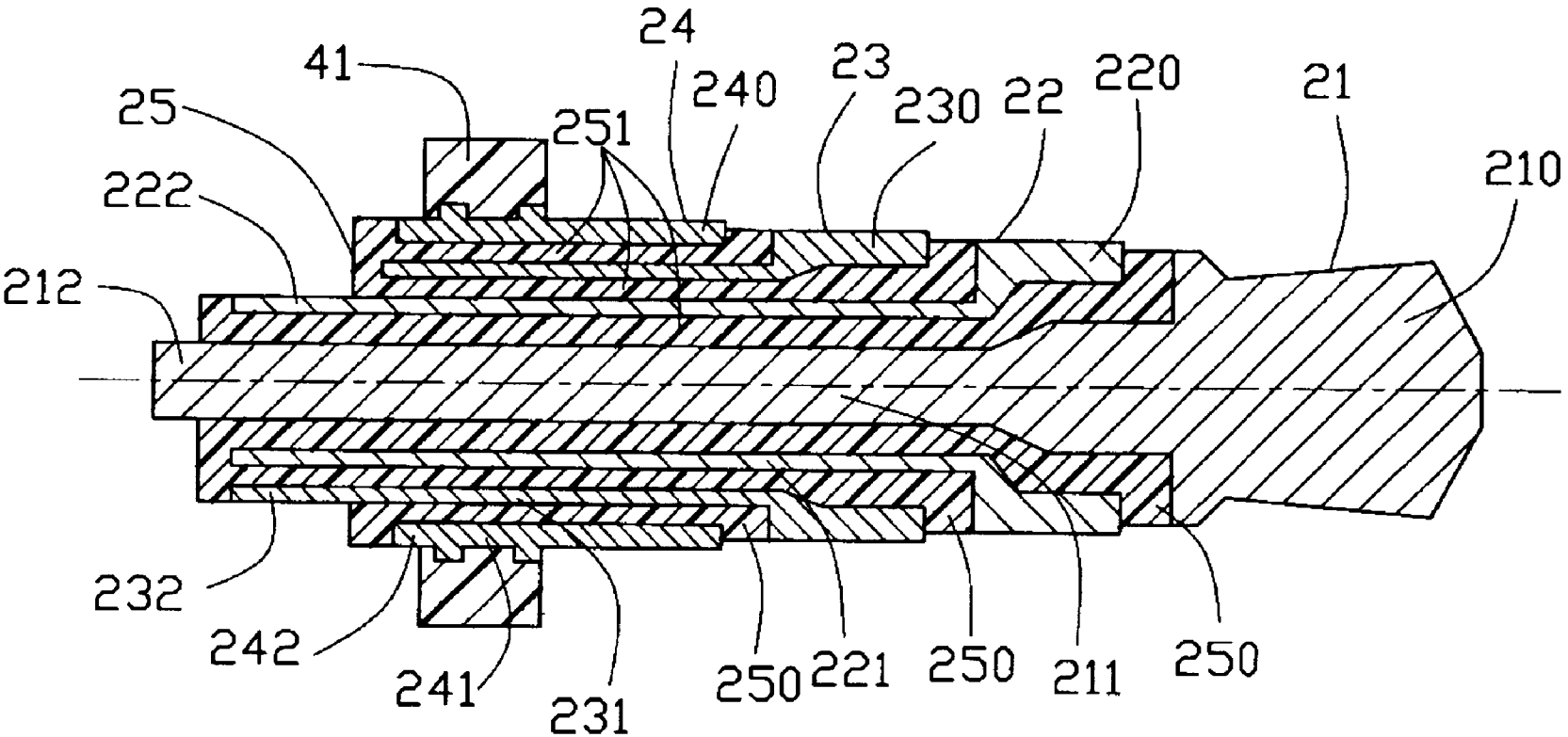
FIG. 4 is a cross-sectional view of the plug connector taken along line 4—4 of FIG. 2.
Figure 5:
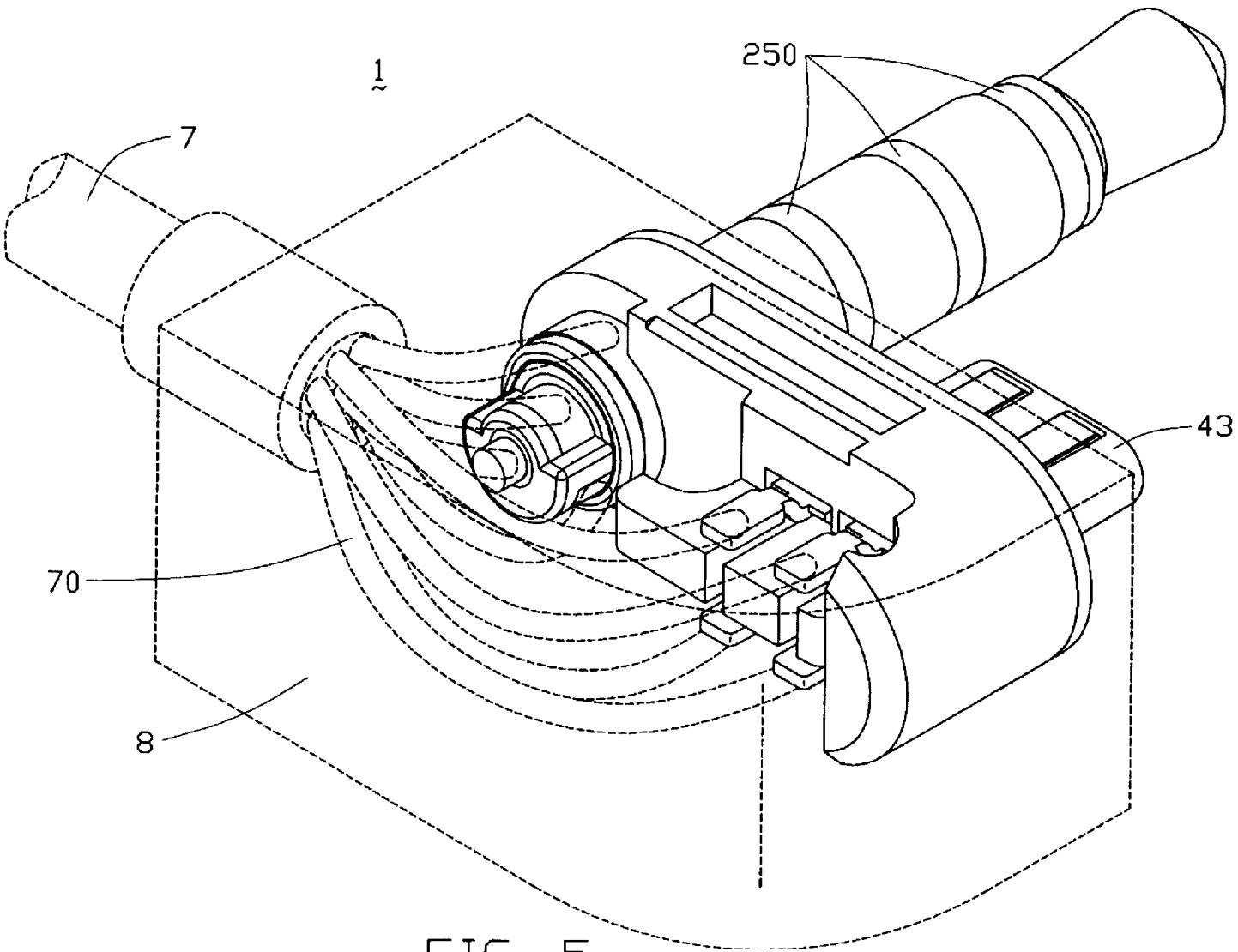
FIG. 5 is a view similar to FIG. 3 with a cable and a plastic enclosure shown in dashed lines.

Referring to FIGS. 3, 4 and 5, the first contact 21 comprises a contact portion 210, an extension portion 211 extending rearwardly from the contact portion 210 along the axis of the audio plug 2, and a rear portion 212 extending rearwardly from the extension portion 211. The second, the third and the fourth contacts 22, 23, 24 each comprises an annular contact portion 220, 230, 240, an annular extension portion 221, 231, 241 extending rearwardly from the contact portions 220, 230, 240, and a rear portion 222, 232, 242 extending rearwardly from the extension portion 221, 231, 241.

The extension portions 211, 221, 231, 241 of the first, the second, the third, the fourth contacts 21, 22, 23, 24 are coaxially arranged from in an inner to outer turn and the diameters of the extension portions 211, 221, 231, 241 increase in sequence. The contact portions 210, 220, 230, 240 of the contacts 21, 22, 23, 24 are insulated from each other by a plurality of annular insulating rings 250 of the insulator 25. The extension portions 211, 221, 231, 241 of the contacts are insulated from each other by a plurality of annular insulating layers 251 of the insulator 25.

The rear portion 212 of the first contact 21 extends rearwardly beyond the insulator 25 for soldering with a wire 70 of a cable 7. An upper half portion of the rear portion 222 of the second contact 22 is exposed upwardly from an upper half portion of the insulating layer 251 between the second and third contacts 22, 23 but not rearwardly beyond the insulating layer 251 between the first and the second contacts 21, 22 for soldering with a second wire 70 of the cable 7. An end face of a lower half portion of the insulating layer 251 between the second and the third contacts 22, 23 is flash with an end face of the insulating layer 251 between the first and the second contacts 21, 22. An end face of an upper half portion of the insulating layer 251 between the second and the third contacts 22, 23 is flash with an end face of the insulating layer 251 between the third and the fourth contacts 23, 24 and is forwardly offset from the end face of the insulating layer 251 between the first and the second contacts 21, 22.

A lower half portion of the rear portion 232 of the third contact 23 is exposed downwardly from a lower half portion of the insulating layer 251 between the third and the fourth contacts 23, 24. An upper portion of the rear portion 232 of the third contact 23 is embedded in the insulator 25. The rear portion 242 of the fourth contact 24 extends not rearwardly beyond the insulating layer 251 between the third and the fourth contacts 23, 24. In such a way, the upper half portion of the rear portion 222 of the second contact 22 and the lower half portion of the rear portion 232 of the third contact 23 are exposed to outside at two diametrically opposite sides of the audio plug 2 respectively for being soldered with the wires 70 of the cable 7 at a same axial position, thereby saving an axial dimension of the audio plug 2.

The insulative housing 4 comprises an elongated base 41 having a front face 410, a rear face 411 opposite to the front face 410, an upper face 412, a lower face 413 opposite to the upper face 412 and two opposite convex end faces 415, 416 connecting the upper face 412 and the lower face 413. The base 41 defines a through hole 42 extending throughout the front face 410 and the rear face 411 on one end thereof. A tongue 43 extends forwardly from the front face 410 and is spaced from the through hole 42. The tongue 43 defines two rows of passageways 430 on opposite upper and lower side faces thereof and extending rearwardly throughout the base 41. The upper face 412 and the lower face 413 of the base 41 each define a rectangular notch 414.

A rectangular spacer 44 extends rearwardly from the rear face 411 of base 41 and is located between the two rows of passageways 430. The spacer 44 has an upper face 440, a lower face 441 opposite to the upper face 440, a rear face 442 and a projection 443 extending laterally from a distal end of the spacer 44 toward the through hole 42 of the base 41 in a direction substantially perpendicular to a direction along which the plug connector 1 mates with a complementary jack connector. The projection 443 is spaced from the rear face 411 of the base 41. The spacer 44 defines a plurality of slots 444 throughout the upper face 440, the lower face 441 and the rear face 442 of the spacer 44. The slots 444 extend forwardly into the tongue 43. Each slot 440 communicates with two opposite passageways 430 on the opposite upper and lower side faces of the tongue 43, so the two opposite passageways 430 can be formed by only one core during the molding process of the insulative housing 4.

An extension 45 extends rearwardly from the rear face 411 and is adjacent to and spaced from the spacer 44. The extension 45 has a convex outer face 450 flush with one end face 416 of the base 41 and a planar inner face 451 facing the spacer 44. A pair of recesses 452 are defined in the inner face 451 of the extension 45.

Each terminal 6 comprises a body portion 61, a contacting portion 62 extending forwardly from a front end of the body portion 61, a connecting portion 63 bent outwardly from a rear end of the body portion 61 and a solder portion 64 extending rearwardly from the connecting portion 63. A plurality of barbs 610 are formed on opposite sides of the body portion 61 to engage with the base 41.

The audio plug 2 is retained to the housing 4 with the contact portion 240 of the fourth contact 24 extending forwardly beyond the front face 410 of the base 41, the extension portion 241 received in the through hole 42 and the rear portion 242 extending rearwardly beyond the rear face 411 of the base 41 and exposing outwardly. The terminals 6 are inserted into the housing 4 from the rear face 411 of the base 41 with the contacting portions 62 received in the passageways 430 on the opposite upper and lower side faces of the tongue 43 and the barbs 610 engaged with the base 41. The solder portions 64 of the terminals 6 are located beside the upper and the lower faces 440, 441 of the housing 4 respectively.

Referring to FIG. 5, in use, rear ends of the contacts 21, 22 of the audio plug 2 and the solder portions 64 of the terminals 6 are soldered to wires 70 of a cable 7 in ways known to persons skilled in the pertinent art, then the rear end of the plug connector 1 is molded in a plastic enclosure 8 in ways known to persons skilled in the pertinent art, the projection 443, the recesses 452 and the notches 414 of the housing engage with the plastic of the enclosure 8 during molding to retain reliably the plug connector 1 in the enclosure 8. When the plug connector 1 together with the enclosure 8 is drawn to disengage from the complementary jack connector, the plastic received the recesses 452, the notches 414 and a space between the projection 443 and the rear face 411 of the base 41 can prevent the plug connector 1 from disengaging from the enclosure 8 and can in turn prevent the contacts 21, 22 and the terminals 6 from separating from the wires 70 of the cable 7.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector, comprising:

an insulative housing comprising a base having a front face and a rear face opposite to the front face, a tongue extending forwardly from the front face of the base, a plurality of passageways extending through the tongue and the base, and a spacer extending rearwardly from the rear face of the base and having a projection laterally extending;

an audio plug secured to the base; and a plurality of terminals received in the passageways of the insulative housing;

wherein the passageways are arranged in two rows on opposite upper and lower side faces of the tongue respectively;

wherein the spacer is located between the two rows of the passageways of the housing and has an upper face, a lower face opposite to the upper face, a rear face, and a plurality of slots extending through the upper face, the lower face and the rear face to meet with the passageways of the housing;

wherein each slot communicates with two opposite passageways on the opposite upper and lower side faces of the tongue;

wherein the base of the housing comprises an upper face and a lower face opposite to the upper face and wherein each of the upper face and the lower face defines a notch;

wherein the base of the housing comprises two opposite convex end faces connecting the upper face and the lower face;

wherein the housing comprises an extension extending rearwardly beyond the rear face of the housing and comprising a convex outer face flush with one end face of the base;

wherein the extension comprises an inner face facing the spacer and defining a pair of recesses.

2. The plug connector as claimed in claim 1, wherein each terminal comprises a body portion with a plurality of barbs engaged with the base, a contacting portion extending forwardly from the body portion and received in the passageway, a connecting portion bent outwardly from the body portion and a solder portion extending rearwardly from the connecting portion.

3. An electrical plug connector assembly comprising:

an insulative housing;

a plurality of contacts concentrically insert-molded in the housing and isolated from each other, each of said contacts including a front contact portion for mating with a corresponding contact of a complementary connector, and a rear solder portion for soldering to a corresponding wire of the cable, the contact portions of the contacts located in different axial positions around a front portion of the housing, the contact portion of one contact of said contacts being substantially located in front of that of another contact of said contacts wherein said one contact is surrounded by said another contact;

the solder portions of most of the contacts located in different axial positions around a rear portion of the housing, the solder portion of one contact of said most of the contacts being substantially located behind that of another contact of said most of the contacts wherein said one contact is surrounded by said another contact; wherein the solder portions of some of said contacts substantially share a same axial position while at different radial positions thereabouts so as to be capable of reducing a whole axial dimension of the said concentrically insert-molded contacts;

wherein a cable includes a plurality of wires respectively soldered to the corresponding solder portions, while being not all along a same radial position;

wherein the housing defines at a same axial position of the rear portion a large semi-cylinder to expose the corresponding solder portion of one contact of said some of the contacts thereon, and a small semi-cylinder to expose thereon the corresponding solder portion of another contact of said some of the contacts, said one contact of said some of the contacts substantially surrounding said another contact of said some of the contacts.

* * * * *